US006716106B2

(12) United States Patent
Wang et al.

(10) Patent No.: US 6,716,106 B2
(45) Date of Patent: Apr. 6, 2004

(54) REAL-SCENE TOUR SIMULATION SYSTEM AND METHOD OF THE SAME

(75) Inventors: Cher Wang, Taipei (TW); Parkson Kuo, Taipei (TW)

(73) Assignee: Via Technologies, Inc. (TW)

( * ) Notice: Subject to any disclaimer, the term of this patent is extended or adjusted under 35 U.S.C. 154(b) by 0 days.

(21) Appl. No.: 10/373,281

(22) Filed: Feb. 24, 2003

(65) Prior Publication Data

US 2003/0211896 A1 Nov. 13, 2003

(30) Foreign Application Priority Data

May 8, 2002 (TW) ..... 91109954 A

(51) Int. Cl.[7] ..... A63G 31/16
(52) U.S. Cl. ..... 472/59; 472/60; 434/55
(58) Field of Search ..... 472/59, 60, 61; 463/7; 434/55, 69

(56) References Cited

U.S. PATENT DOCUMENTS 1,789,680 A * 1/1931 Gwinnett ..... 472/60
4,630,817 A * 12/1986 Buckley ..... 463/37
5,711,670 A * 1/1998 Barr ..... 434/55
5,951,404 A * 9/1999 Oishi et al. ..... 472/60
6,200,138 B1 * 3/2001 Ando et al. ..... 434/61
6,361,321 B1 * 3/2002 Huston et al. ..... 434/69
6,471,586 B1 * 10/2002 Aiki et al. ..... 463/6
6,558,164 B2 * 5/2003 Raha ..... 434/62

* cited by examiner

*Primary Examiner*—Kien T. Nguyen

(57) ABSTRACT

The present invention relates to a real-scene tour simulation system and method of the same. As illustrated in a preferred embodiment of the present invention, the user could select a tour location (tour destination) through the Geographic Information System (GIS) or an expert system and set up the parameters for the tour such as the tour speed and the tour timeframe. The real-scene tour simulation system and method of the present invention will load in environment parameters based on the selected tour location, simulate the real scene of the tour based on the environment parameters, for example the terrain, the atmospheric temperature, the sunshine intensity and the environment sound effect, associated with the selected tour location and present the simulation result to the user.

20 Claims, 6 Drawing Sheets

REAL-SCENE TOUR SIMULATION SYSTEM AND METHOD OF THE SAME

BACKGROUND OF THE INVENTION (a). Field of the Invention

The present invention relates to a real-scene tour simulation system and method of the same. Especially, the present invention relates to a real-scene tour simulation system and method that can simulate a real outdoor scene interiorly, which makes an user feel like taking a real tour in the real world.

(b). Description of the Prior Arts

As technology advancing rapidly day by day, people are getting tense in daily life. In order to catch up a working pace, modern people need to spend more time on job and in learning. Therefore, in the spare time, they normally do not have too much time and energy for outdoor activities. Meanwhile, local popular tourist spots are always crowded in weekends and holiday periods, and an international tour trip needs longer time for arrangement. That is why, in holiday, many people prefer staying at home reading books or magazines, browsing the Internet or playing computer game rather than going outdoor. Obviously, people living in the modern age even have better material life, while the quality of life is really awful.

Also, because of the sophisticated communication technology, a global village is forming; many businessmen are traveling around the world everyday. However, the purpose of their trip is limited to business; they only can take a brief look at the tourist spots during the breaks of their business trips. But for the constrains of time, their sightseeing is just only a passing glance at things, and photos might be taken for memorial if there is a chance. Moreover, it is unlikely to visit the same place again, not under a business trip, even the place is worth visiting for many times, which is quite a pity.

SUMMARY OF THE INVENTION

The primary aspect of the present invention is to provide a real-scene tour simulation system and method of the same, which simulates real outdoor scenes interiorly and makes the user feel like taking a real tour in the real world.

In a preferred embodiment of the present invention, the user could select a tour location (tour destination) from a tour location display system and set up the parameters for the tour, such as speed and time. The real-scene tour simulation system and method of the present invention will load environment parameters in based on the selected tour location, simulate the real scene of the tour based on the environment parameters, such as the terrain, the atmospheric temperature, the sunshine intensity and the environment sound effect associated with the selected tour location and present the simulation result to the user. Then, the real-scene tour simulation system and method of the present invention will simulate the environmental scenario in a real time manner and present the simulation result to the user. The user can take an indoor tour just like taking an outdoor tour in the real scene in the real world.

The real-scene tour simulation system of the present invention comprises an activity system; a display device used to display the images to the user; an audio system used to create the environmental sound effect of the tour location; a control unit used to control the operation of the real-scene simulation system; an air conditioning system used to create the airflow effect of the tour location; a controlled light source used to control the brightness of light of the tour location and an input device providing the user a function to input the tour location, the tour pace and the tour timeframe. The control unit can be built with the Application Specific Integrated Circuit (ASIC) and embedded in the real-scene tour simulation system to execute the program code used to control the real-scene tour simulation system In the preferred embodiment of the present invention, the user sets up the tour activity parameters according to the activity he wants to perform, such as jogging or walking, and the activity system will simulate the scenario based on the activity parameters. Moreover, the activity system in the preferred embodiment of the present invention could be built with sport exercise equipments like treadmill or sport bike, and the tour location display system could be an interactive system like a geographic information system or an expert system.

DETAILED DESCRIPTION OF THE PRESENT INVENTION

Please refer to FIG. 1A to FIG. 1D, FIG. 1A to FIG. 1D show the diagrams of an example on how an user selects a tour location via a geographic information system (GIS). The tour locations shown in FIG. 1A to FIG. 1D include holiday resorts, historical interests and hot tour spots in Taiwan. In fact, the preferred embodiments of the present invention cover any country as well as any place in the universe via the geographic information system. For example, the geographic information system can provide the world map (or can be the map of the Moon, the Solar System or the Universe) for selection, and an user can select any country on the world map for tour, thus making the user feel like taking a real outdoor tour while having an indoor activity.

Figure 1B:
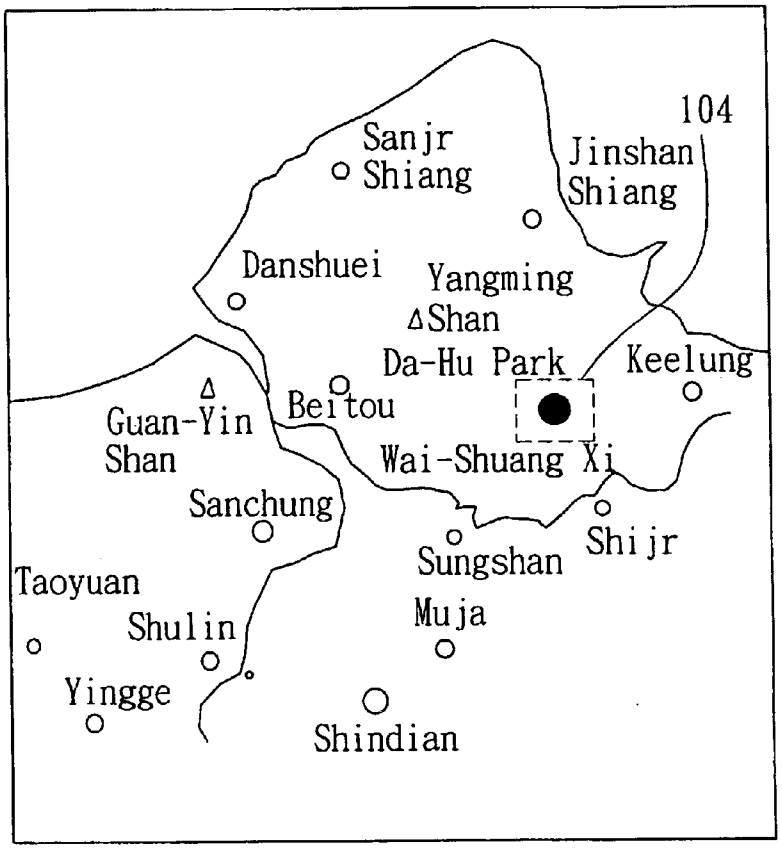
FIG. 1A to FIG. 1D show the diagrams of an example how an user selects a tour location via the geographical information system.
Figure 1A:
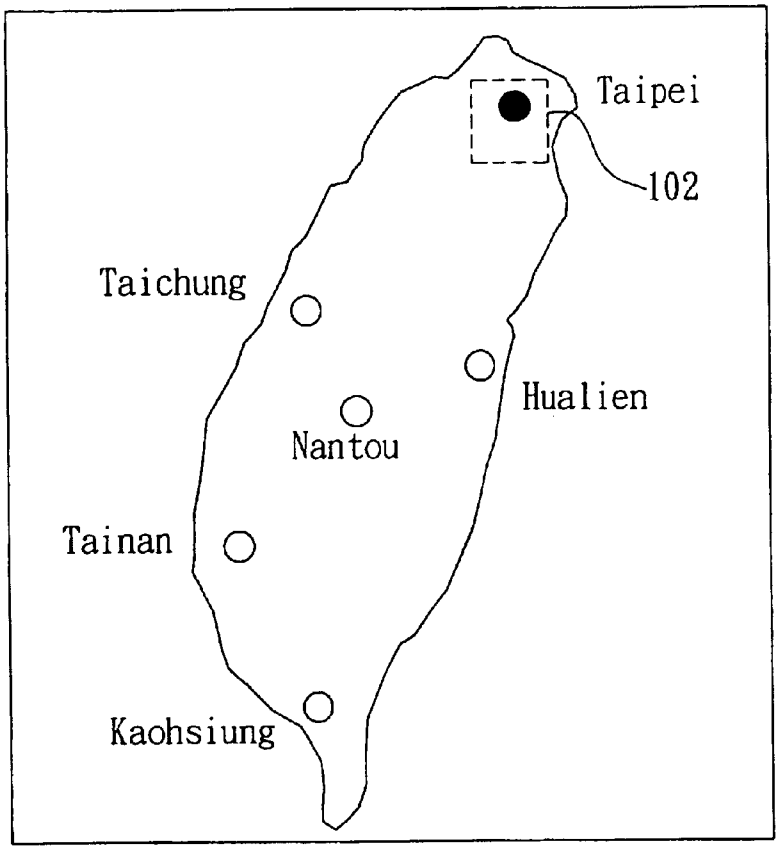
Figure 1D:
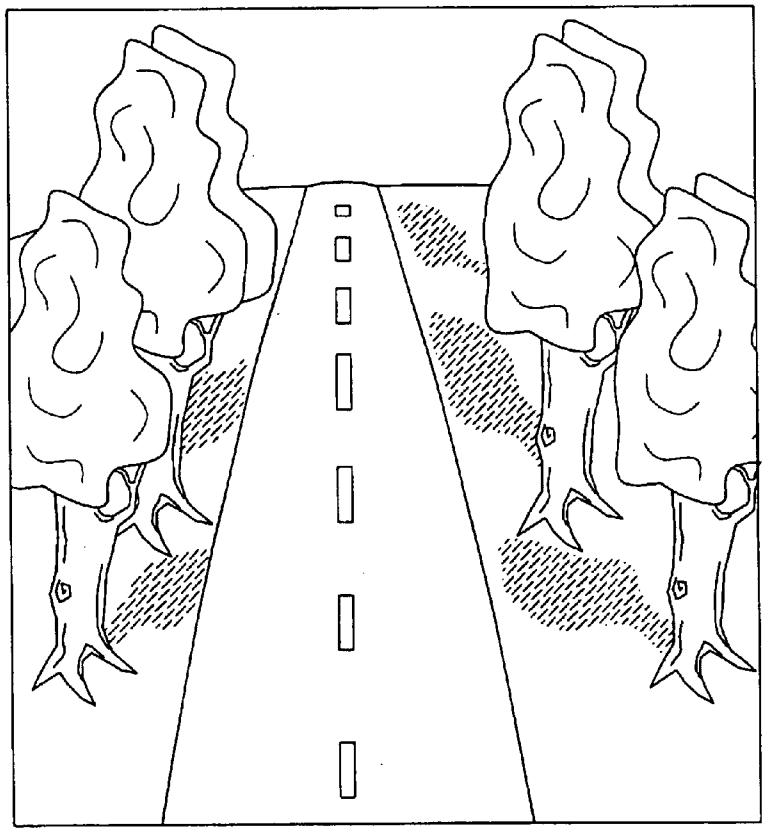
Figure 1C:
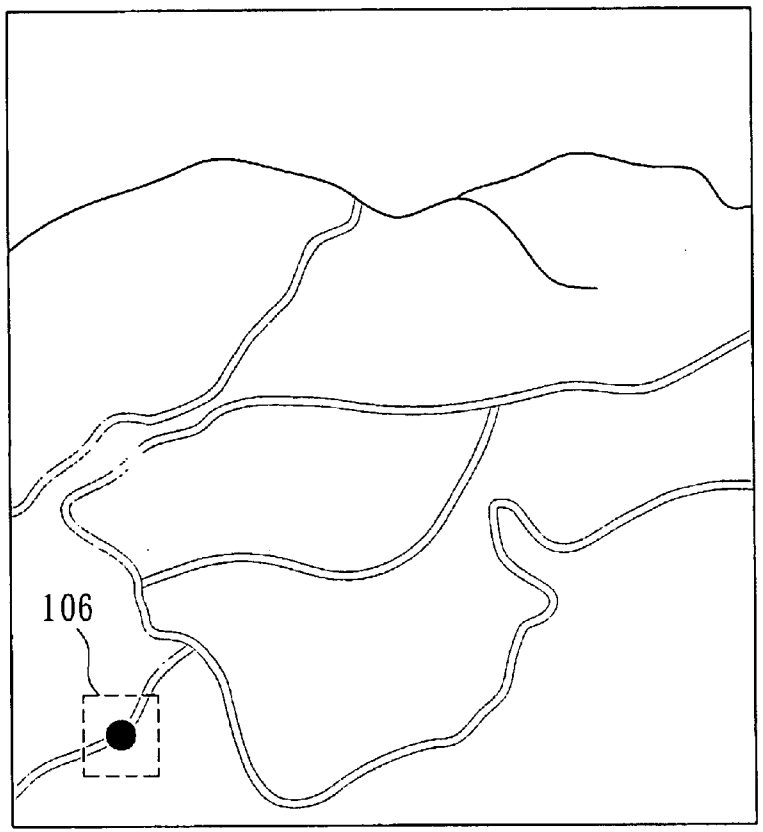

Firstly, the user can select a city on the map of Taiwan, as shown in FIG. 1A, by using a cursor 102, say selecting Taipei as the city to visit. The geographic information system therefore displays the map of Taipei as shown in FIG. 1B to the user and the user uses a cursor 104 to select a tour location, and as shown, the tour location is Da-Hu Park. The geographic information system further displays the scene of Da-Hu Park to the user via FIG. 1C, and the user uses a cursor 106 to select the starting point at the chosen tour location to proceed the tour. Finally, the real-scene tour simulation system of the present invention displays the scene of the starting point of the tour via FIG. 1D and simulates the environment of the starting point and presents to the user. One important thing is that the user almost can select any location for tour, however, in reality, some geographical environments can never be realized, at least not with the current technologies. For example, if the user selects the "cloud" in the sky as the tour location, the tour will be an impossible one because of the limitation of the technology. In another case, unless the user selects a transportation tool (such as a boat) first, he/she will not be able to "walk" in a river. In one preferred embodiment, the system of the present invention will determine if the tour can be taken based on the location selected by the user. If the tour cannot be taken in a reasonable way, the system will automatically select a possible tour location for user; or via Virtual Reality (VR) technology, to simulate and display the simulation result to the user. For example, if the user selects a tour traveling in a river, the system will display a scene just like the user is taking the tour riding in a boat. Various possible modifications, omissions, and alterations could be conceived of by persons skilled in the art to the form and the content of any particular embodiment described above, without departing from the scope of the present invention.

Figure 2:
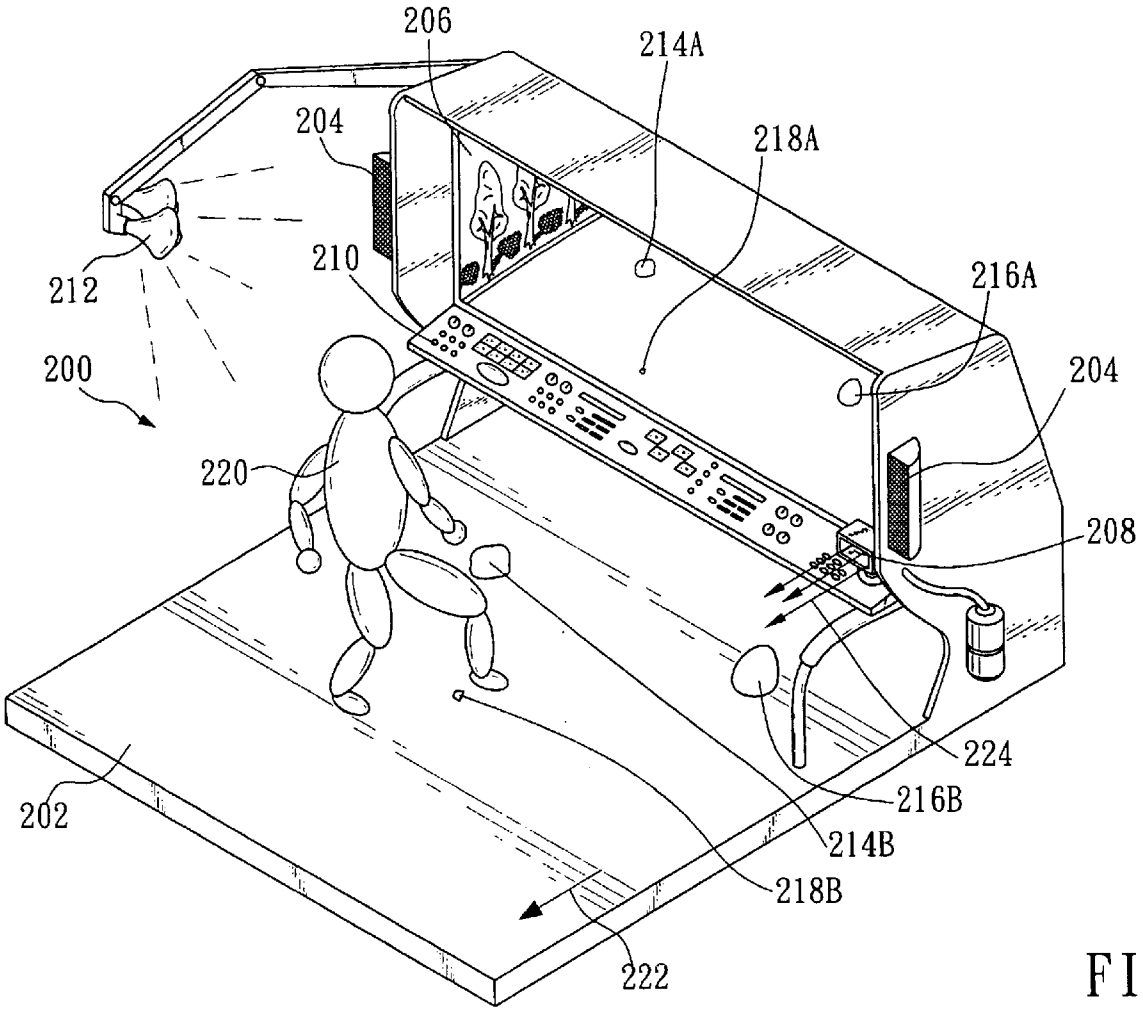
FIG. 2 shows a preferred embodiment of the present invention where an user takes tours on an activity platform.
Figure 5B:
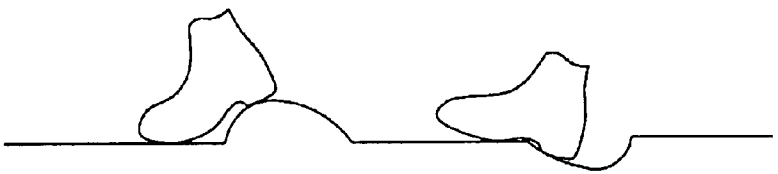
FIG. 5A to FIG. 5B show the diagrams that an user is walking on a slope and stepping on a stone and a pit hole.
Figure 5A:
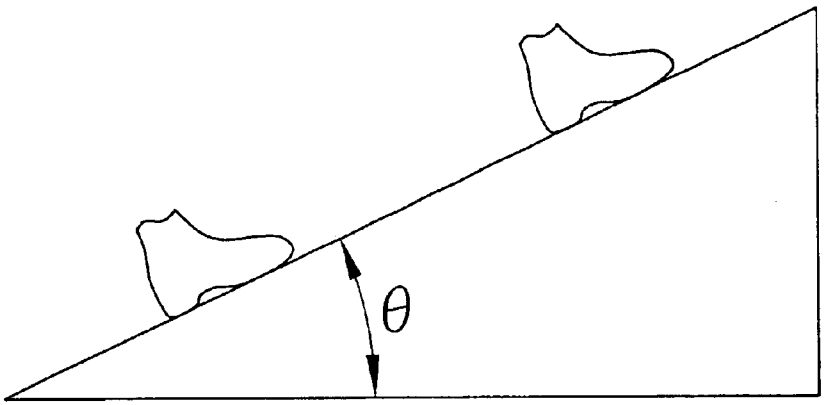

FIG. 2 shows a diagram that the user takes a tour with the real-scene tour simulation system 200. As shown in the figure, the real-scene tour simulation system 200 of the present invention comprises an activity platform 202, a speaker 204, a display screen 206, an air conditioning device 208, a keyboard 210, a controlled light source 212 and the activity platform 202 on which a user 220 is performing. When the user uses the real-scene tour simulation system 200 for taking a tour, he can use the keyboard 210 to select a tour location, and the operational flow is shown in FIG. 1A to FIG. 1D. Once the tour location has been selected, the scene of that tour location will be displayed to the user 220 via the display screen 206, the condition of the temperature and the sunshine at the tour location will be simulated by the air conditioning device 208 and the controlled light source 212 respectively, and the simulation result will be presented to the user. Moreover, the geographical environment condition is simulated and presented by the activity platform 202. For example, when the user is walking up a slope, like what is shown in FIG. 5A, the activity platform 202 will calculate the related variables, such as the degree of inclination θ, and simulate the geographical environment condition based on the slope of the road, which eventually makes the user apply more energy to walk on the road being simulated on the activity platform 202. In another example, if the scene selected by the user has a big stone 214A, a small stone 218A and a pit 216A on the road, the system will generate the situation and present on the activity platform 202, as what is illustrated in FIG. 5B, and thus making the user feel like walking on the road with all the stones and pits. To simulate that scenario, the real-scene tour simulation system 200 will send out an associated signal, and the activity platform 202 will simulate accordingly. When the user 220 enters the simulated tour location, the activity platform 202 will present extruding objects 214B and 218B and a pit hole 216B corresponding to the stones 214A, 218A (the big stone and the small stone respectively) and the pit 216A. So, when the user 220 steps on the extruding objects 214B and 218B, it will make the user 220 feel like stepping on the stones 214A and 218A, in the same way, when the user 220 steps on the pit hole 216B, it makes the user feel like stepping on the pit 216A shown on the display screen 206. In another example, when the user is moving faster (the moving direction of the activity platform 202 is represented by an arrow 222), the air conditioning device 208 will increase the speed of the wind blow (the wind blow direction of the air conditioning device 208 is represented by an arrow 224) that makes the user having the feeling of taking a real tour. In another matter of fact, when the user starts the tour activity (such as walking or jogging), the controlled light source 212 will change the brightness of light according to the shadow of the trees or the mountains on both sides of the road. Besides, even the user is not on the activity platform 202; the real-scene tour simulation system 200 of the present invention can still simulate the real scene of any tour location and display to the user. Certainly, for some tour spot like a beach in Hawaii, the user can lie on the activity platform 202 and the system will simulate the scenario of the beach, the speaker 204 will create an sound effect just like an ocean wave tapping on the beach, the display screen 206 will show clouds in the blue sky, the air conditioning device 208 will create a warm breeze from the beach and the controlled light source 212 will illustrate the sunshine on the Hawaiian beach. More importantly, the activity platform 202 in FIG. 2 can be any popular sport exercise equipment, such as a treadmill or a bike. Of course, some other video game systems such as the car racing game platform can be built in the real-scene tour simulation system 200. Moreover, the quantity and the arrangement of the speakers 204, the air conditioning device 208 and the controlled light source 212 will not be limited as shown in the FIG. 2, any modification can be made by any person skilled in the art based on the described embodiment without departing from the scope of the present invention.

Figure 3:
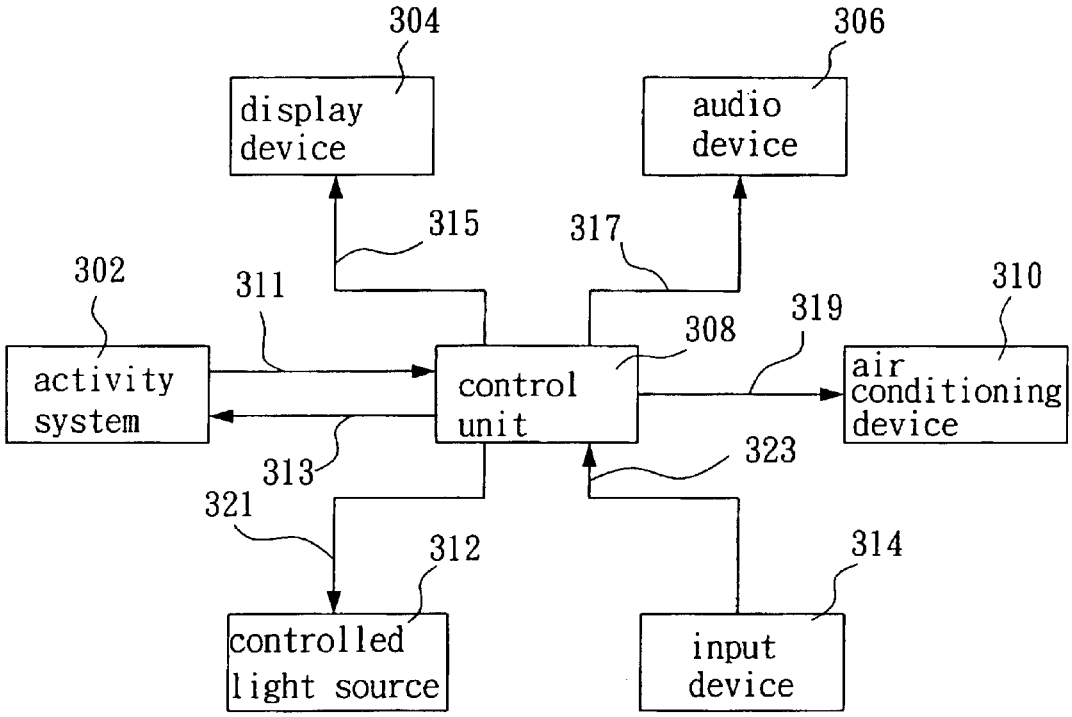
FIG. 3 shows a block diagram of a real-scene tour simulation system of the present invention.

Please refer to FIG. 3 now, which shows a block diagram of the real-scene tour simulation system of the present invention. Wherein, the real-scene tour simulation system comprises an activity system 302 (including the activity platform 202 of FIG. 2) provided to the user for performing activities thereon; a display device 304 (including the display screen 206 of FIG. 2) used to display the scene to the user; an audio device 306 (such as the speakers 204 of FIG. 2) used to broadcast the audio signal of the environment of the tour location; a control unit 308 used to control the operation of the real-scene tour simulation system; a air conditioning device 310 (such as the air condition device 208 of FIG. 2) used to generate wind blow for the tour location; a controlled light source 312 (such as the controlled light source 212 of FIG. 2) used to adjust the brightness of light according to the tour location; a input device 314 (it could be the keyboard 210 of FIG. 2) with which the user input the tour information such as the tour location, the activity pace and the tour timeframe. After the user selects the tour location and inputs the tour parameters through the input device 314, the relevant instructions and parameters will be inputted (along with the route 323) to the control unit 308. Then, the control unit 308 transfers control signals to the activity system 302, the display device 304, the audio device 306, the air conditioning device 310 and the controlled light source 312 via routes 313, 315, 317, 319 and 321 respectively to simulate the real scene of the tour location. Meanwhile, activities that the user performs on the activity system 302 will be transferred back to the control unit 308 via route 311. After the user starts the tour, the control unit 308 will start the simulation according to the tour parameters set up by the user and the simulation result will be further sent to the activity system 302, the display device 304, the audio device 306, the air conditioning device 310 and the controlled light source 312.

The display device 304 and the audio system 306 in the real-scene tour simulation system could be built up with any kind of multimedia device or system, and the air conditioning device 310 and the controlled light source 312 can be any common device or system. For example, the display device 304 could be a cathode-ray-tube (CRT) display system, a liquid crystal display (LCD) system or a plasma display system. Large size display screen and large size activity platform could be used to create better simulation effect, and numerous screens installed at different angles will also generate excellent simulation scene. Besides, the audio system could be a general twin-channel panning audio device, a hi-fi stereo system or a home theater 5.1D audio system. The air conditioning device 310 and the controlled light source 312 could be any available device or system in the market. The control unit 308 can be built with any Application Specific Integrated Circuit (ASIC) and embedded in the real-scene tour simulation system to read program code and control the operation of the real-scene tour simulation. The program code (such as the one used to control the operation in FIG. 4) could be stored in the ASIC or a memory (like ROM, EEPROM or Flash) that can be read out by the ASIC. Moreover, the geographic information system or the expert system in the embodiment of the present invention could be embedded directly in the ASIC and provide the information when the user selects the tour location or provide the real time information via a network (such as Internet or Local Area Network). The input device 314 could be any kind of keyboards such as the keyboard connected directly with the activity system 302 (just like the control keyboard 210 illustrated in FIG. 2) or a separate keyboard, or can be a wireless transfer device (such as a remote controller). The activity system 302 used in the present invention could be any activity system that is able to receive the simulation signal (such as the signal indicating a protruding object or a pit) from the control unit 308, without departing from the scope and the spirit of the present invention.

Figure 4:
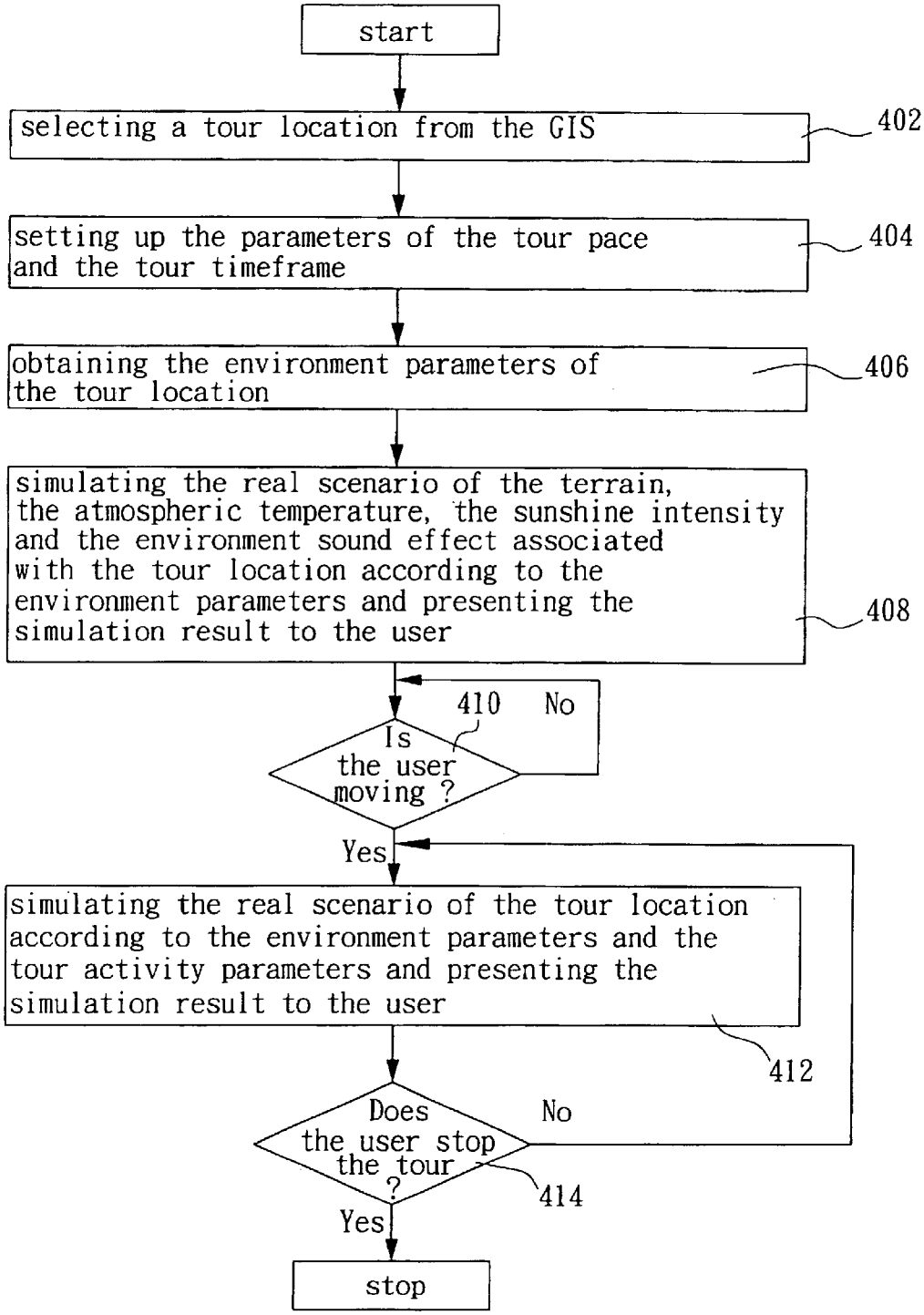
FIG. 4 shows the diagram of an operational flow chart of the real-scene tour simulation system of the present invention.

Next, referring now to FIG. 4 which illustrates an operational flow of the real-scene tour simulation system in the preferred embodiments of the present invention.

When a user employs the real-scene tour simulation system to take a tour, he could select a tour location (step 402) on the geographic information system (or a expert system) provided by the real-scene tour simulation system and further set up the parameters; such as the tour pace and the tour timeframe, for the tour (step 404). Then, in step 406, the real-scene tour simulation system will obtain the environment parameters of the terrain, the weather, the atmospheric temperature, the wind speed and the sound effect of the tour location and simulate the terrain, the atmospheric temperature, the sunshine intensity, the environment sound effect associated with the tour location according to the parameters obtained, and present the simulation result to the user (step 408). As described, the real-scene tour simulation system simulates the terrain, the atmospheric temperature, the wind speed, the sunshine intensity and the environment sound effect associated with the tour location through the activity system 302, the display device 304, the audio device 306, the air conditioning device 310 and the controlled light source 312, and present the simulation result to the user. When the user starts moving along the tour (step 410), the real-scene tour simulation system will start the simulation in real time according to the tour activity parameters set up by the user and the environment parameters, and present the simulation result to the user (step 412) until the user stop the tour (step 414). More importantly, the real-scene tour simulation system will simulate the real environmental scenario according to the tour parameters set up by the user right after the step 408 and until the end of the step 414, while the possible modification can be made without departing from scope and the spirit of the present invention.

As a conclusion, the real-scene tour simulation system disclosed in the present invention provides an user the system and method with which the user could select a tour location via geographic information system. After the user selects the tour location, the system and the method will simulate the terrain, the atmospheric temperature, the sunshine intensity, the environment sound effect associated with the selected tour location and present the simulation result to the user. The system and the method of the present invention will also simulate the environment scenario in a real time manner as the user is moving along the tour to make the user feel like taking a real outdoor tour.

While the present invention has been shown and described with reference to some preferred embodiments thereof, and in terms of the illustrative drawings, it should be not considered as limited thereby. Various possible modification, omission, and alterations could be conceived of by one skilled in the art to the form and the content of any particular embodiment, without departing from the scope and the spirit of the present invention.

What is claimed is:

1. A real-scene tour simulation system that simulates real scenes interiorly to make a user feel like taking a real outdoor tour while having an indoor activity, said real-scene tour simulation system comprising:

a tour location display system for displaying tour locations to said user to select from, wherein said user can choose a tour location from said tour location display system to proceed a tour;

an input device with which said user inputs a chosen tour location and tour activity parameters;

an environment simulation system for generating an environment-like simulation effect to present to said user;

an activity system with which said user can perform activities on, said activity system having means for changing the topography of the surface on which the user is situated; and a control unit responding to said tour activity parameters and environment parameters of said chosen tour location to generate a tour simulation result which simulates said user taking a real tour at said chosen tour location, and output said tour simulation result to said environment simulation system and said activity system for presenting to said user.

2. The real-scene tour simulation system according to claim 1, wherein said tour location display system is a geographic information system (GIS).

3. The real-scene tour simulation system according to claim 1, wherein said tour location display system is an expert system.

4. The real-scene tour simulation system according to claim 1, wherein said environment simulation system comprises at least one of the following: a display device; an audio device; an air conditioning device; and a light source, for presenting said tour simulation result of said tour location to said user.

5. The real-scene tour simulation system according to claim 4, wherein said display device is selected from the group consisting of cathode ray tube (CRT) display system, liquid crystal display (LCD) system and plasma display system.

6. The real-scene tour simulation system according to claim 4, wherein said audio device is selected from the group consisting of twin-channel panning sound system, hi-fl stereo system and home theater 5.1D sound system.

7. The real-scene tour simulation system according to claim 1, wherein said activity system responds to said tour simulation result of said chosen tour location, and presents a terrain simulation result of said chosen tour location to said user.

8. The real-scene tour simulation system according to claim 1, wherein said activity system comprises an exercise equipment system.

9. The real-scene tour simulation system according to claim 1, wherein said activity system comprises a video game system.

10. The real-scene tour simulation system according to claim 1, wherein said tour simulation result includes at least one of the following simulation results associated with said chosen tour location: terrain; atmospheric temperature; sunshine intensity; and environmental sound effect.

11. A real-scene simulation method that simulates real scenes interiorly to make a user feel like taking a real outdoor tour while having an indoor activity, said real-scene simulation method comprises the following steps:

providing an activity platform on which said user can perform activities selecting a tour location on a tour location display system;

inputting tour activity parameters;

obtaining environment parameters of said tour location; and generating a tour simulation result that simulates said user taking a tour at said tour location according to said tour activity parameters and said environment parameters, including changing the topography of the activity platform; and presenting said tour simulation result to said user.

12. The real-scene tour simulation method according to claim 11, wherein said tour location display system is selected from the group consisting of geographic information system (GIS) and expert system.

13. The real-scene tour simulation method according to claim 11, wherein said tour simulation result is presented to said user via an environment simulation system.

14. The real-scene tour simulation method according to claim 13, wherein said environment simulation system comprises at least one of the following: a display device; an audio device; an air conditioning device; and a light source.

15. The real-scene tour simulation method according to claim 14, wherein said display device is selected from the group consisting of cathode ray tube (CRT) display system, liquid crystal display (LCD) system and plasma display system.

16. The real-scene tour simulation method according to claim 14, wherein said audio device is selected from the group consisting of twin-channel panning sound system, hi-fl stereo system and home theater 5.1D sound system.

17. The real-scene tour simulation method according to claim 11 wherein said activity platform responds to said tour simulation result of said tour location.

18. The real-scene tour simulation method according to claim 17, wherein said activity platform comprises an exercise equipment system.

19. The real-scene tour simulation method according to claim 17, wherein said activity platform comprises a video game system.

20. The real-scene tour simulation method according to claim 11, wherein said tour simulation result includes at least one of the following simulation results associated with said tour location: terrain; atmospheric temperature; sunshine intensity; and environmental sound effect.

* * * * *